United States Patent [19]

Whitaker

[11] 4,003,100

[45] Jan. 18, 1977

[54] POOL CLEANING DEVICE

[76] Inventor: James L. Whitaker, 1420 NE. 16th Terrace, Fort Lauderdale, Fla. 33304

[22] Filed: Jan. 15, 1975

[21] Appl. No.: 541,119

[52] U.S. Cl. ..... 15/1.7; 15/257.9; 294/19 R

[51] Int. Cl.[2] ..... E04H 3/20

[58] Field of Search ..... 15/1.7, 257.1, 257.9; 294/1 R, 19 R, 55; 210/471, 242; 43/11

[56] References Cited

UNITED STATES PATENTS

| | | | |
|---|---|---|---|
| 2,902,705 | 9/1959 | Eistrup | 15/1.7 |
| 3,220,037 | 11/1965 | Ruhling | 15/1.7 |
| 3,659,891 | 5/1972 | Pettenon | 294/1 R X |
| 3,688,433 | 9/1972 | Niskin | 43/7 X |
| 3,863,237 | 1/1975 | Doerr | 15/1.7 |

*Primary Examiner*—Edward L. Roberts

[57] ABSTRACT

There is disclosed means for cleaning swimming pools or the like, to remove foreign material such as leaves, comprising a body having hollow form generally speaking, and having angularly dipsosed lips at one end which create rolling currents to raise materials from the bottom of a pool as the body is moving forwardly while submerged in the water of the pool, the body being hollow and continued movement thereof causing the materials to move through the body into a collecting member of foraminous flexible form, and collapsible to retain the material collected against movement out of the member when the body is moved rearwardly.

4 Claims, 3 Drawing Figures

POOL CLEANING DEVICE

OBJECTS OF THE INVENTION

It is a principal object of this invention to provide a simple pool cleaning device which is essentially a hollow body member, having specially formed lips at one end to create rolling currents which tend to pick up leaves or like light materials from the bottom of a pool, causing them to pass through the body into a formaminous flexible bag-like member attached to the rear of the body, movement of the body in other than a forward direction, causing the bag member to collapse and retain the materials collected therein whether for repositioning movement of the body or for removing the materials already collected from the pool.

Another object of the invention is to form the body with an entrance end having lips extending therearound, which create the rolling currents and tending to centralize light materials which are floating or resting on the bottom, causing them to enter the body and pass into a collecting member attached thereto.

Another object of the invention is to form the body of the device hereunder consideration in such a manner as to cause the foraminous flexible bag-like member attached to the rear of the body to collapse and in so doing, close so as to retain materials already collected therewithin and prevent them from escaping again into the water of the pool or the like.

Another object of the invention is to form the body of the device herein under consideration of light weight form, fasten the handle rigidly thereto which will control the attitude of the body, the body being hollow and desirably maintained in use with its axis generally horizontal, the rear of the body being slanted or sloped in its connection with the foraminous flexible member so that when the member collapses it will in effect provide a closed position of the flexible member and prevent the escape of materials from the body.

Other and further objects of the invention will be understood from a consideration of the specification appended hereto and disclosed in the drawing wherein.

DESCRIPTION OF THE INVENTION

Figure 1:
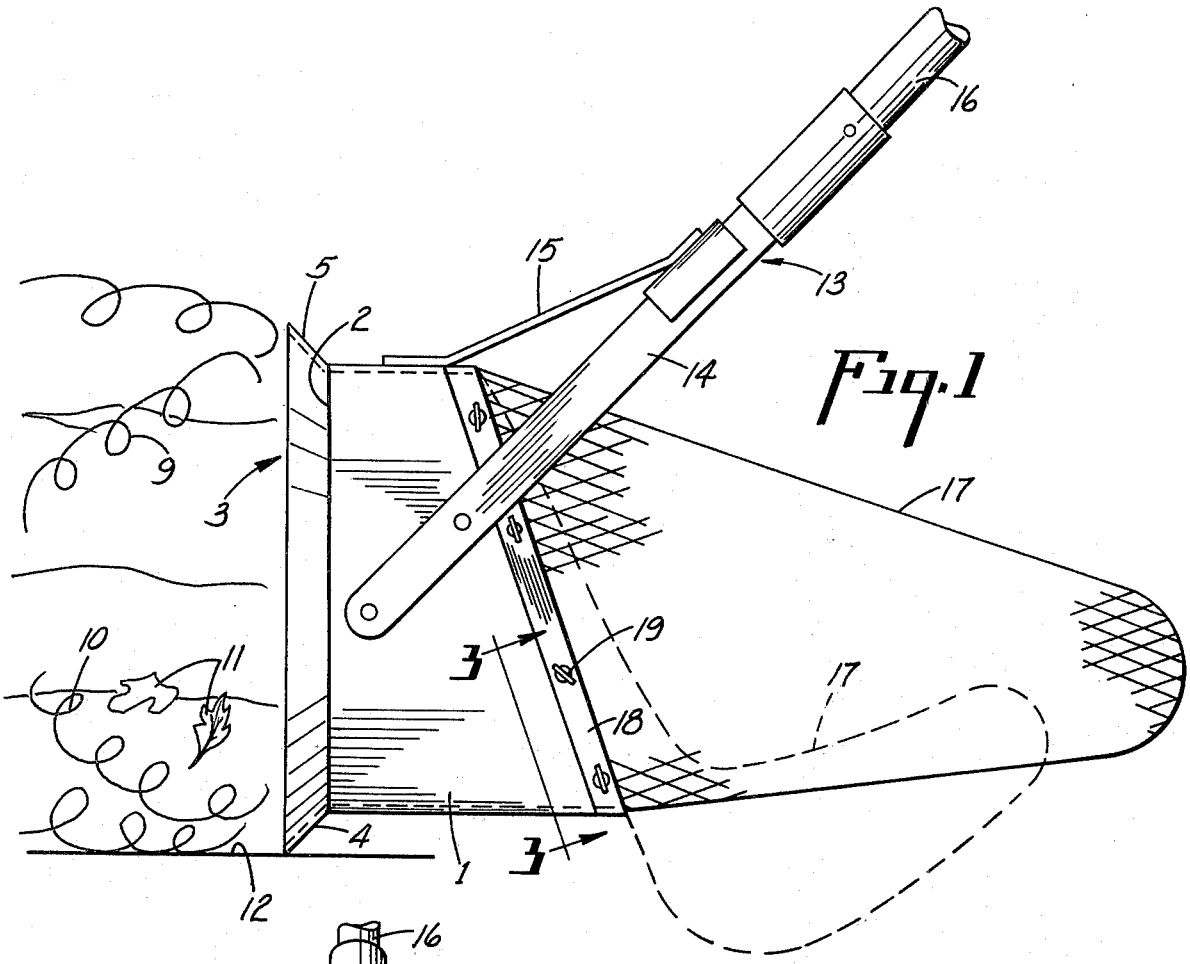
FIG. 1 is a somewhat fragmentary view, showing the device hereof, and certain of its actions together with the collecting member attached thereto in receiving position and in closed position.
Figure 2:
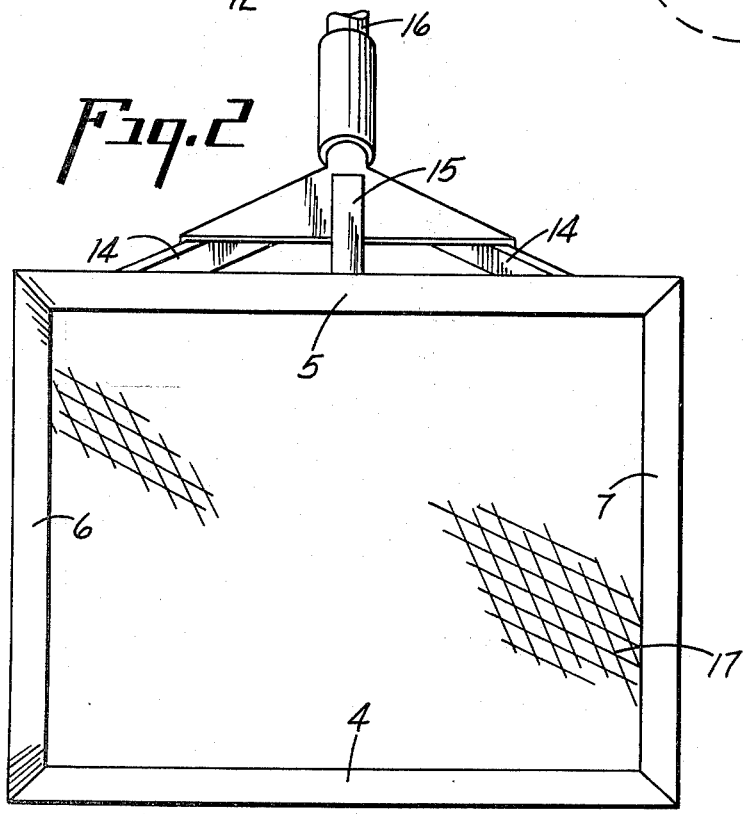
FIG. 2 is a front view of the device of FIG. 1.
Figure 3:
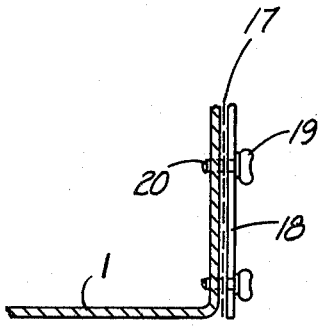
FIG. 3 is a fragmentary sectional view, taken about on the line 3—3 of FIG. 1, looking in the direction of the arrows.

Referring now to FIG. 1, the device hereof is shown as comprising a body generally denoted 1 of what may be termed tubular form, being rectilinear in elevation, having at its forward end 2 the lip structure generally denoted 3 which, as shown in FIG. 2, comprises a lower lip 4, an upper lip 5 and side lips 6 and 7, these lips being as shown integral with the body and flared so to speak at the forward end 2, in this case being shown as lying at about 45 degrees with respect to the axis designated 8 of the body 1.

Since the body is of relatively thin material and thus light, the lips 4 to 7 inclusive are preferably integral therewith and as indicated arranged to provide, during movement of the body, a sort of rolling current effect suggested at 9 and 10 which cause the leaves suggested at 11 to be raised off the bottom of the pool generally designated at 12, and pass into the interior of the body 1 by continued forward movement of the body in the left-hand direction as viewed in FIG. 1.

Such movement may of course be effected by the handle structure generally designated 13, including the side connections 14 and the top connection 15 to maintain the body rigidly in position with respect to the handle structure, a manipulating handle shown only fragmentarily being designated at 16 and removable if desired in accordance with any conventional type of structure.

In order to collect leaves such as 11, which have been rolled or caused to move upwardly as by the current suggested at 9 and 10 in leftward movement of the body, the leaves passing thereinto, there is provided a foraminous bag-like member or a collecting member, generally designated at 17; this bag-like member is perhaps a mesh bag or the like, and fastened around the periphery of the rear of the body as by means of the clamping parts 18 which in this instance are flat metal parts or similar means, engaging the mouth of the bag-like member 17 and maintained in position by the wing nuts 19 which include the threaded ends 20 to enter suitable threaded openings formed in the rear end of the body 1.

The rear end or end at the periphery of the body 1 is provided with strips 18 therearound to maintain the bag-like member 17 in its connected position, the rear end of the body 1 being sloped at the angle shown so that when the body 1 is moved rearwardly, the bag-like member 17, or collecting member 17, will collapse into the dotted line position suggested in FIG. 1 for example.

It will be apparent that this collapse will in effect close the rear end of the body 1 and this is the intent hereof so as to prevent the escape of materials already collected therewithin, this collapsing action taking place when the body is moved rearwardly or when it is merely permitted to lie at rest in the position shown in FIG. 1.

The angular nature of the rear end of the body 1 is such as to make this collapse easily accomplished without any real effort on the part of the person manipulating the device, and when effort is made to cause the collapse of course, this accentuating the same and thus the preventing of escape of materials collected.

While there is shown the lips 4 to 7 inclusive as lying at an angle of about 45 degrees with the axis of the device, generally designated 8, it will be apparent that some variation from this is contemplated but it has been found that the angular disposition stated is the most suitable one for purposes hereof and creates the best current action in accordance with observations made during use.

It is also contemplated, as will be readily apparent, that lips 4 and 5 for example can be provided without the necessity for having the lips 6 and 7 formed likewise, but the use of the lips 6 and 7 further accentuates the current characteristics and accomplishes the objectives hereof more suitably.

I claim:

1. In a pool cleaning device of the class described, in combination, a hollow rectilinear body of thin sheet material constructed to be moved through water whilst submerged therein, and having provision for water passage therethrough, flat angular lips extending around the opening, the lips being divergently angularly positioned with respect to the body and forward end thereof, and of sufficient extent whereby to create a rolling current at said end, cause light foreign materials affected thereby to be moved upwardly from the surface upon which they are resting and pass into the body and a collecting member attached thereto whilst said body is moved as stated, the rear end of the body having means to attach a collecting member thereto, a bag-like collecting member of flexible formainous material connected to the rear end of the body so as to trail therebehind when the body is moved in the direction of the forward end, said member being of sufficient length whereby to collapse over and close the said rear end when the body is at rest and moved in the direction of said end, to retain foreign materials collected in the member, and means to move said body.

2. The combination as claimed in claim 1, wherein the plane of the periphery of the rear end of the body is angularly positioned with respect to the axis of the body, and the collecting member is fastened to said periphery and thereby lies at that angle when collapsed as stated.

3. The combination as claimed in claim 1, wherein the lip is positioned at about 45° with respect to the axis of the body.

4. The combination as claimed in claim 3, wherein the means to move the body, comprises a handle fixed thereto whereby to maintain the axis of the body substantially parallel to the surface from which the foreign materials are to be removed.

* * * * *